US008117709B2

(12) United States Patent
McLain

(10) Patent No.: US 8,117,709 B2
(45) Date of Patent: Feb. 21, 2012

(54) BUFFING SYSTEM INCLUDING LOAD ABSORBING FIXTURE WITH MULTIPLE COMPRESSION LOAD DEFLECTION AND REPLACEABLE WORKING FACE

(75) Inventor: Scott S. McLain, Mukwonago, WI (US)

(73) Assignee: Lake Country Manufacturing, Inc., Hartland, WI (US)

( * ) Notice: Subject to any disclaimer, the term of this patent is extended or adjusted under 35 U.S.C. 154(b) by 969 days.

(21) Appl. No.: 12/082,674

(22) Filed: Apr. 11, 2008

(65) Prior Publication Data

US 2008/0216272 A1 Sep. 11, 2008

Related U.S. Application Data

(63) Continuation-in-part of application No. 10/939,174, filed on Sep. 10, 2004, now abandoned.

(51) Int. Cl.
*A47L 25/00* (2006.01)

(52) U.S. Cl. ..... 15/230.18; 15/230.19; 15/230; 15/244.1

(58) Field of Classification Search ..... 15/230, 15/230.18, 230.19, 244.1, 97.1; 451/359
See application file for complete search history.

(56) References Cited

U.S. PATENT DOCUMENTS

| | | | |
|---|---|---|---|
| 3,346,904 | A | 10/1967 | Armstrong |
| 3,924,362 | A | 12/1975 | McAleer |
| 4,263,755 | A | 4/1981 | Globus |
| 4,437,271 | A | 3/1984 | McAvoy |
| 4,536,911 | A | 8/1985 | Demetriades |
| 5,001,804 | A | 3/1991 | Roeker et al. |
| 5,003,659 | A | 4/1991 | Paepke |
| 5,138,735 | A | 8/1992 | Kusz et al. |
| 5,309,681 | A | 5/1994 | Cheney et al. |
| 5,944,586 | A | 8/1999 | Sevigny et al. |
| 5,946,760 | A | 9/1999 | Eames, Jr. |
| 6,044,512 | A | 4/2000 | Hornby et al. |
| 6,929,539 | B2 | 8/2005 | Schutz et al. |

FOREIGN PATENT DOCUMENTS

| | | |
|---|---|---|
| GB | 2 003 770 | 3/1979 |
| WO | 9901257 | 1/1999 |

*Primary Examiner* — Shay Karls

(74) *Attorney, Agent, or Firm* — Andrus, Sceales, Starke & Sawall, LLP

(57) ABSTRACT

A rotary buffing and finishing system includes a polymeric foam cushioning layer that has a graded compression load deflection which is interposed between a backing plate and a relatively thin performance layer that is removably attached to the foam cushioning layer. The backing plate is flexible but has a compression load deflection greater than the cushioning layer, and the cushioning layer includes two foam layers of graded compression load deflection that decreases from a rear face to a front face. The system provides improved performance over thicker and more expensive performance layers while reducing operator fatigue.

20 Claims, 3 Drawing Sheets

BUFFING SYSTEM INCLUDING LOAD ABSORBING FIXTURE WITH MULTIPLE COMPRESSION LOAD DEFLECTION AND REPLACEABLE WORKING FACE

CROSS REFERENCE TO RELATED APPLICATIONS

This application is a continuation-in-part of application Ser. No. 10/939,174, filed Sep. 10, 2004 and entitled "Buffing Pad with Graded Flexibility and Replaceable Working Face."

BACKGROUND OF THE INVENTION

The present invention pertains to rotary or dual action buffing, polishing and finishing pads and, more particularly, to a composite system that includes an intermediate cushioning layer having a graded compression load deflection (CLD) and a thin performance layer that provides the necessary surface finishing function, but can be easily and inexpensively replaced when worn or damaged. The graded compression load deflection fixture performs and replaces the function provided by full thickness prior art buffing pads. The system of the present invention provides a consistent compression load deflection over the useful life of a wide range of buffing materials and avoids the problems of pad degradation and operator fatigue associated with prior art systems. In a particularly unique embodiment, the performance layer is attached to a cushioning layer having a rounded outer edge that permits finishing operations in a full range of angles up to 90°.

The current state of prior art systems typically includes a backing plate with minimal cushioning in combination with a monolithic full thickness polymeric foam buffing pad. Polymeric foam buffing pads have been used for many years to perform a variety of buffing and finishing functions for painted and clear coat surfaces in the automotive and other industries. The full thickness pad provides a combination of surface finishing performance and cushioning effect required for proper operator performance. However, open cell polyurethane foam materials are expensive. Typical polyurethane foam pads range in size from less than 6 inches to greater than 8 inches (about 150-200 mm) in diameter, and 1.25 to 1.75 inches (about 30-45 mm) in thickness. The thickness of the material, in particular, is necessary to provide proper cushioning for the desired finishing operation. However, only a small part of the surface contacting face of the pad is actively used for the desired buffing or finishing operation. The use of full thickness pads thus results in about ⅔ of the pad being unnecessarily wasted when the thin operative surface contacting face is exhausted by wear, damage or contamination.

Notwithstanding the accepted performance of open cell polyurethane foams in buffing, polishing and finishing operations, the high cost of these materials is not the only drawback. All polymeric foams undergo some amount of permanent collapse and decrease in thickness after an applied load. The open cellular structure of these materials is crushed under load and the initial thickness is never fully recovered. In addition, different grades of open cell polyurethane foam have varying compressibilities and, as a result, perform differently in a finishing operation. In addition, open cell polyurethane foams are typically hydrophilic and will absorb water in use. The result is that the compressive strength and cushioning effect of full thickness foam pads is greatly diminished with repeated use. Heat generated in use also increases softening. As a result, with a full thickness open cell polyurethane buffing layer, most of the cushioning effect is lost and performance rapidly degrades with use. Finally, although polyurethane foam pads with curved outer edges have been developed, permitting the operator to buff on an angle, great care must still be taken by the operator to avoid edge load concentration because of pad edge configuration or a lack of cushioned support which can result in cutting or burning of the painted surface. The cushioned rounded edge of one embodiment of the system of the present invention solves these problems.

Other buffing pad materials, such as tufted wool, are also typically provided with a long nap (i.e. 1.25 inches or more) that provide a significant cushioning effect while the actual buffing performance is carried only by the outer ends of the wool strands. In these products, the ingress of water and finishing compound into the base of the fibers which are tufted to a backing layer, results in fiber loss and rapid deterioration in cushioning performance.

SUMMARY OF THE INVENTION

In accordance with the present invention, most of the cushioned support for a polyurethane foam buffing, polishing and finishing pad is provided by polymeric foam material that does not directly contact the surface to be finished and may be provided with a graded flexibility or graded levels of compression load deflection. This composite pad construction provides performance that is identical to a monolithic open cell polyurethane foam pad, but at considerably less cost. A thin performance layer is removably attached to the foam cushioning layer that can be reused repeatedly.

The principal features of the subject invention can be applied to buffing pads other than those made of open cell polyurethane foam, such as tufted wool mentioned above. The use of a thin tufted wool performance layer, in the range for example of ⅜ to ½ inch in fiber length, not only reduces considerably the cost, but when combined with the graded CLD backing plate of the subject invention, will result in an improved performance.

An important aspect of the present invention is that the operating load imposed on the thin performance layer is transferred largely to a graded CLD backing plate. As a result, the amount of permanent collapse of the thin performance layer is much less than with a conventional full thickness pad of open cell polyurethane foam or other high performance finishing material. Pad life is extended and consistent performance over the life of the pad is better. In addition, the cushioning layer in the graded CLD backing plate, preferably made from a closed cell urethane foam, provides consistently low compression load deflection over a wide range of popular performance layer materials, resulting in improved performance and lower operator fatigue.

The graded CLD cushioning layer is provided in a unique configuration in which the graded CLD urethane foam is molded around the outer edge of a somewhat flexible molded backing plate, made of nylon or similar material, whereby the performance layer may also be made or made to conform to a rounded cushioned buffing edge. Unlike prior art systems, this permits the operator to buff on an angle from the horizontal that may be a full 90° angle (perpendicular to the surface) while providing full cushioning and protection against surface burning or cutting.

Thus, a rotary or dual action buffing and finishing apparatus of the type that provides flexible cushioned support for a high performance contacting face, includes a polymeric foam cushioning layer that has a graded compression load deflection that decreases from a rear face to a front face and provides the primary cushioned support. A thin performance layer provides the entire high performance surface contact unlike prior art systems and is removably attached to the foam cushioning layer.

The apparatus of the present invention preferably includes a backing plate that is attached to the rear face of the foam cushioning layer and supports the foam cushioning layer. The backing plate and the cushioning layer may comprise an integrally molded urethane material that provides the graded compression load deflection that varies from a relatively hard but somewhat flexible backing plate to a much softer front face for attachment to the performance layer.

In one embodiment, the backing plate has a circular front face that is rotatable on a center hub with an axis perpendicular to the front face, the foam cushioning layer is also of a circular shape and has one-half of a hook and loop fastener attached to its front face. A performance layer, which is also circular in shape, has a rear face that carries the other half of the hook and loop fastener and a front operating face that is selected to provide a surface contact optimized for a given buffing, polishing or finishing operation. The performance layer may be selected from the group consisting of open cell polyurethane foam, non-woven fibers, tufted wool, knitted wool, polymer microfibers, and combinations thereof.

The hook and loop fastener halves may be heat laminated or glued to the respective faces of the foam cushioning layer and the performance layer. Either one of the interfaces between the hook and loop fastener halves and the faces of the cushioning layer or performance layer, preferably the latter, may be provided with a barrier material to prevent migration of liquid and compound from the performance layer to the foam cushioning layer.

In one embodiment of the apparatus, the front face of the foam cushioning layer is generally planar and terminates in an outer edge that is upwardly rounded. A portion of the half of the hook and loop fastener is positioned on the rounded outer edge and the other half of the fastener on the performance layer is dimensioned to wrap around the outer edge to engage the portion of the first half of the fastener. This imparts a cup shape to the performance layer. Alternately, the performance layer may be preformed to a dished or cup shape such that the portion of the hook and loop fastener on the rounded outer edge may be eliminated.

In a presently preferred embodiment of the invention, the combination of a graded CLD cushioning layer of a polymeric foam, such as closed cell urethane, molded to a flexible plastic backing plate, combined with a thin disposable performance layer having a thickness not greater than about 0.5 inch provides a high performance surface for buffing, polishing or finishing that provides a surface finish comparable to that provided by conventional full thickness pads, typically having a thickness of about 1.25 inches or more. The performance layer is demountably attached to the cushioning layer and, when so attached, the combined apparatus exhibits a maximum initial vertical compressive load when compressed 0.5 inch of not more than about 75 lbs. Further, the change between the maximum initial load and a minimum relaxed load after repeated cycles of 0.5 inch compression held for one minute lies in a range of about 20% to 40%. In addition, the foam cushioning layer is defined by an outer edge that is generally circular in cross section and the performance layer has a rounded outer edge with an inner surface that abuts and conforms to the outer edge of the cushioning layer. The lower cost performance layer can last in use as long as a full thickness pad of the prior art, yet cost as little as about ⅕th the cost of the full thickness pad.

DETAILED DESCRIPTION OF THE PREFERRED EMBODIMENTS

Figure 1:
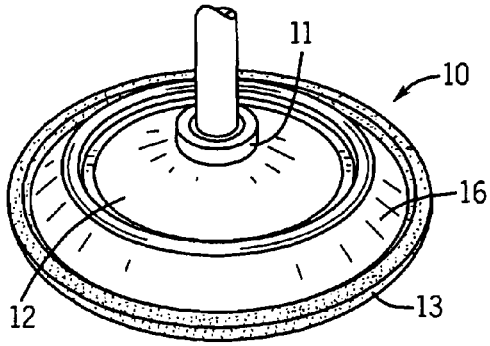
FIG. 1 is a perspective view of a rotary buffing and finishing pad assembly of the present invention mounted on the drive shaft of a power driving machine.
Figure 2:
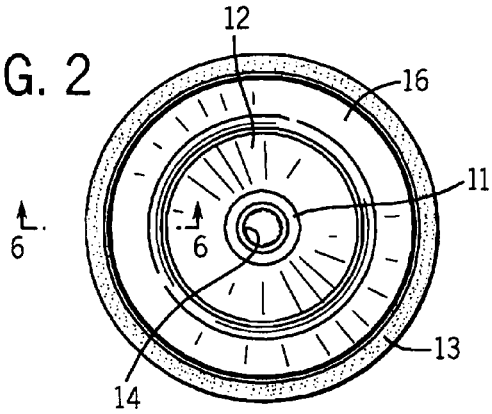
FIG. 2 is a top plan view of the assembly shown in FIG. 1.
Figure 4:
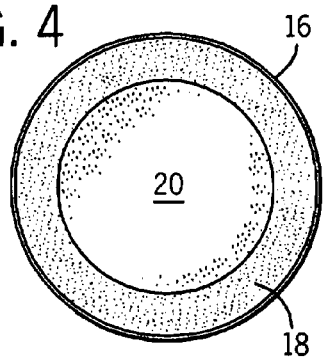
FIG. 4 is a bottom plan view of the cushioning layer of the assembly taken on line 4-4 of FIG. 3.

In FIGS. 1-4, a rotary buffing and finishing tool assembly 10 includes a one-piece hub 11 and backing plate 12, carrying an intermediate cushioning layer 16 to which is releasably attached a relatively thin circular performance layer 13 that provides surface contact for the buffing or finishing operation. The hub 11 is preferably made of a hard plastic, such as a molded nylon, and includes a central nut 14 insert molded into the hub to provide connection to a power driving tool. The integral backing plate 12 extends radially outwardly from the hub 11 and has a generally conical front face 15 that ends in a flattened outer edge 19. The cushioning layer 16, preferably of a polymeric foam material, is attached to the hub and the front face 15 of the backing plate and also extends upwardly around the peripheral edge 19 of the backing plate 12 to form a rounded outer edge 17. The front face 18 of the cushioning layer 16 is generally flat and has attached thereto a circular fastener layer 20 comprising one-half of a hook and loop fastener (typically the hook half). In the embodiment shown, the rounded outer edge 17 of the cushioning layer 16 has attached thereto an outwardly facing thin fastener strip 21, also comprising the same hook and loop fastener material as the circular fastener layer 20.

The performance layer 13, comprising a reticulated open cell polyurethane foam in the example shown, is cut in the shape of a thin circular disc. The thickness of the performance layer 13 may be about ⅜ inch (about 10 mm), but the thickness may vary considerably, particularly if the performance layer is selected from an entirely different material as will be discussed hereinafter. However, a performance layer thickness greater than about 0.5 inch does not provide enhanced performance and unnecessarily adds to the cost. A thicker pad is also difficult to form around the fixture. The rear face 22 of the performance layer 13 has attached thereto a circular fastener layer 23 comprising the other half of the hook and loop fastener (typically the loop half), i.e. complimentary to the circular fastener layer 20 on the front face of the cushioning layer 16. In this embodiment, the diameter of the performance layer 13 is larger than the diameter of the cushioning layer 16. The outer edge of the polyurethane foam performance layer 13 is turned upward and wrapped around the rounded outer edge 17 of the cushioning layer. The edge of the circular fastener layer 23 on the rear face of the performance layer 13 engages the fastener strip 21 on the rounded outer edge 17 of the cushioning layer to hold the performance layer in a cupped shape, as shown.

The cushioning layer 16, in the embodiment shown, is molded directly to the hub and backing plate 11, 12. In accordance with an important aspect of the present invention, the cushioning layer 16 is formed with a graded compression load deflection that decreases from a rear face 24 in contact with the front face 15 of the backing plate to the front face 18 where it is attached to the rear face of the performance layer 13. The term "compression load deflection" is used in the polymeric foam industry as a measure of the compressibility of a foam material. In one standard test, the compression load deflection (CLD) is measured at 40% compression of a test piece. For one fully reticulated open cell polyurethane foam, a CLD of 0.65 to 1.25 psi (about 4.5 to 8.6 kPa) is typical. The average density of this foam is 2.4 lbs./ft.$^3$ (38.5 kg/m$^3$). The cushioning layer 16 is molded such that its compression load deflection (or equivalent property) decreases from the rear face 24 (adjacent the backing plate 12) to the front face 18 (where it is attached to the rear face of the performance layer 13). The polymeric foam from which the cushioning layer 16 is formed provides a cushioning effect that is virtually the same as it would be if the combined cushioning layer and performance layer were made of a single monolithic piece of high performance open cell polyurethane foam. Foam materials, such as molded closed cell polyurethane may be used. This cushioning system can be used repeatedly, whereas a major portion of the full thickness pad that provides cushioning in prior art systems is unnecessarily wasted. In addition, closed cell urethane foams are typically hydrophobic and do not absorb water that can seriously affect performance. Further, closed cell urethane foams are less subject to compressive crushing. The backing plate 12 may also be made of a material which, though significantly harder than the foam cushioning layer 16, retains a flexibility that adds to the cushioning effect. A satisfactory result may be obtained with a construction utilizing a flexible backing plate 12, made for example of molded nylon, and a cushioning layer 16 that comprises a material of varying hardness across its full depth. In general, whether the graded cushioning effect provided by the components of the subject invention is measured by compression load deflection, durometer or density, the key is that such property decreases from the backing plate to the front face 18 of the cushioning layer 16.

Figure 3:
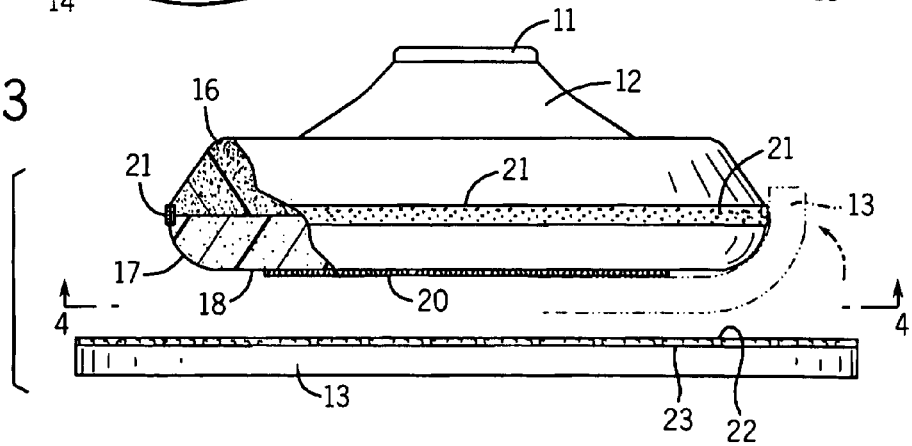
FIG. 3 is an exploded view of the assembly shown in FIGS. 1 and 2.
Figure 5:
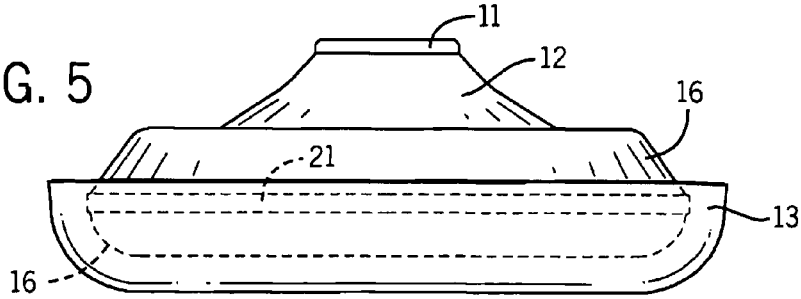
FIG. 5 is an assembled elevation view of the apparatus of FIG. 3.
Figure 6:
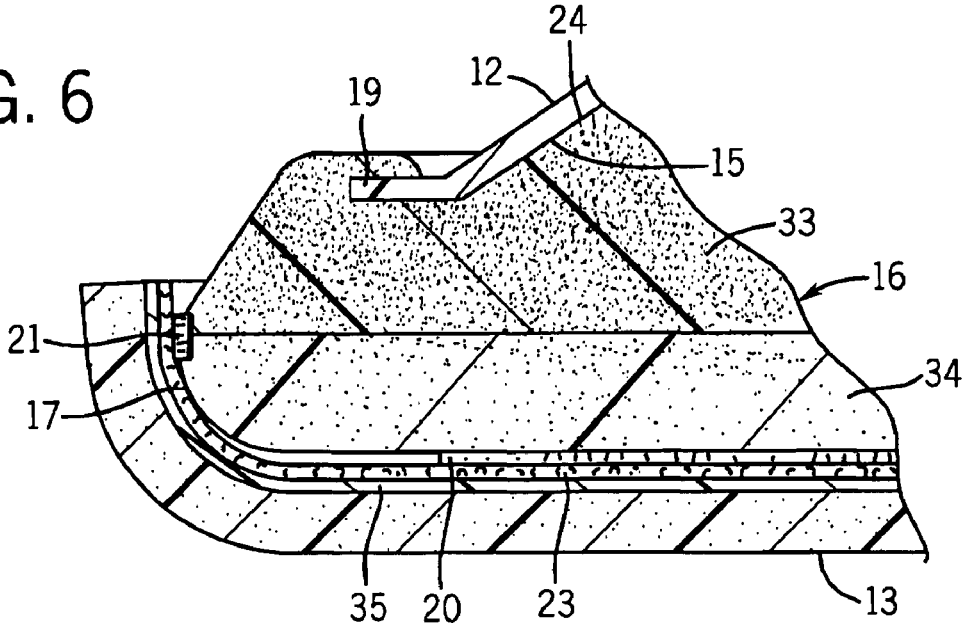
FIG. 6 is a sectional detail of FIG. 5.

In the embodiment shown and referring particularly to FIGS. 3 and 6, the graded CLD (or graded durometer) of the cushioning layer 16 is provided by joining two separate layers of polyurethane foam having different CLDs (and densities). A first layer 33 of higher CLD polyurethane foam is molded to the hub and backing plate 11, 12 and second layer 34 of a lower CLD polyurethane foam is molded directly to the first layer 33. In one example of a pad of the type shown in FIG. 3, molded polyurethane foam layers 33 and 34 having respective durometers (Shore A) of about 30 to 32 and 10 to 15 were used to form a cushioning layer 16 having a diameter of 4.5 inches (about 115 mm). The second layer 34 had a uniform thickness of about ½ inch (about 13 mm), and the thickness of the upper layer 33, though having a variable cross-section, also averaged about ½ inch (13 mm) in thickness. The first layer 33 is also molded to extend around the flattened outer edge 19 of the backing plate, as shown.

When the performance layer 13 becomes excessively worn or torn, or becomes plugged with buffing or finishing compound, the thin performance layer 13 may simply be peeled away from the cushioning layer 16 and replaced. This results in a considerable saving where a monolithic high performance foam buffing pad, having a typical thickness in the range of 1.25 to 1.5 inches (about 32 to 40 mm), would otherwise have to be discarded.

Each of the circular fastener layers 20 and 23 (as well as the fastener strip 21) normally includes an adhesive layer that is used to adhere the fastener layers to the surfaces being joined. In the assembly of the present invention, however, the adhesive layers are preferably eliminated and the hook and loop fastening pieces are adhered directly to the respective foam cushioning layer and foam performance layer by flame lamination or other suitable heating or gluing process.

It is also desirable, in certain applications, to provide the interface between one of the fastener layers 20 or 23 and the respective foam layer 16 or 13, preferably the performance layer 13 and fastener layer 33, with a layer 35 of an impervious barrier material. This prevents migration of finishing liquids or compounds from the performance layer 13 into the foam cushioning layers 16. A layer of barrier material would thus protect the foam cushioning layer, and when applied to the rear face 22 of the performance layer 13, will also protect the fastener layers 20 and 23 from contamination and plugging.

The unitary hub and backing plate 11, 12 can also be molded separately and the cushioning layer 16 also formed separately and attached to the front face 15 of the backing plate 12. Attachment of the foam cushioning layer to the backing plate can be permanent, as by gluing or heat bonding, or demountable as with a hook and loop fastening system.

As may be seen best in FIG. 6, the backing plate 12 has a relatively thin sections from the flattened outer edge 19 all the way to their juncture with the hub 11. Although the molded plastic hub and backing plate is relatively hard, as compared to the various foam materials, the thin section of the backing plate adds an additional measure of flexibility to the buffing and finishing assembly. It is believed that this additional flexibility enhances the overall performance and permits the use of heavier, more dense and higher CLD foam materials in the cushioning layer 16 and 17, as compared to a single monolithic block of open cell polyurethane foam such as comprises the performance layers 16.

The thin performance layers of open cell polyurethane foam that characterize the previously described embodiments may be replaced with performance layers of other materials using the same cushioning layer and back-up plate arrangements previously described. Thus, performance layers of tufted wool, knitted wool, non-woven fibers, polymer microfibers, and combinations thereof, all in relatively thin sections, may be used. As with the previously described performance layer embodiments, these alternate performance layers should also be provided with a layer of barrier material to prevent contamination of the fastener system and the cushioning layer.

Figure 7:
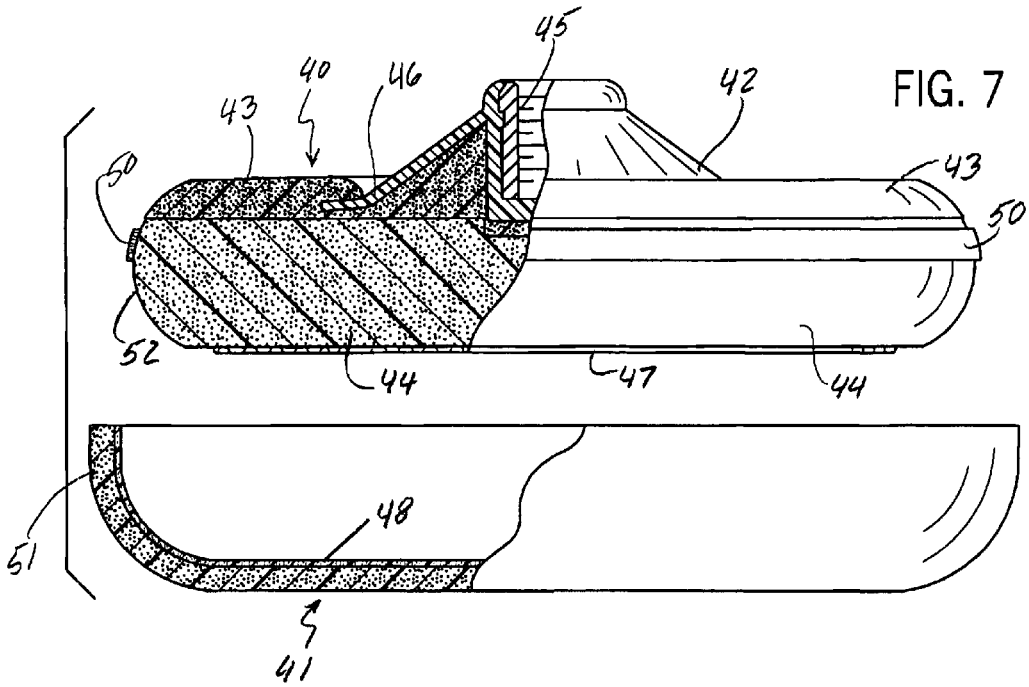
FIG. 7 is an exploded view of a graded density backing plate and a preformed thin performance layer.
Figure 8:
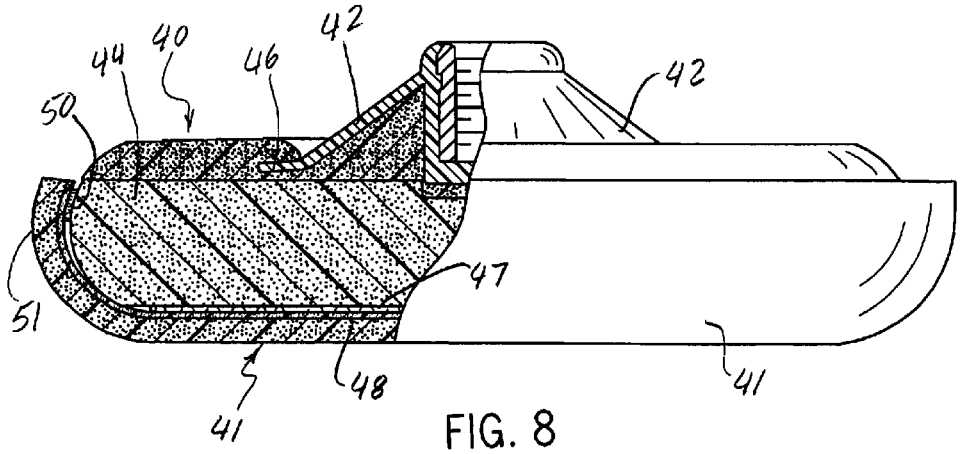
FIG. 8 shows an assembly of the FIG. 7 components.

In FIGS. 7 and 8, there is shown a backing plate assembly 40 and performance layer 41 of a presently preferred embodiment of the invention. The backing plate assembly 40 may be compared to a tool fixture to which the tool in the form of the performance layer 41 is demountably attached. The backing assembly 40 is similar to the previously described embodiments and includes an integral hub and backing plate 42, an upper cushioning layer 43 and a lower cushioning layer 44. An attachment nut 45 is insert molded into the hub in a conventional manner. The unitary hub and backing plate 42 includes a thin peripheral edge 46 to which the upper cushioning layer 43 is molded. The lower cushioning layer 44 is, in turn, molded to the bottom of the upper cushioning layer 43, in a manner generally similar to the previously described embodiments. The unitary hub and backing plate 42 is molded from a nylon material such that the peripheral edge 46 retains considerable flexibility, but is still much harder than the two foam cushioning layers 43 and 44. In this embodiment, both cushioning layers are made from a closed cell urethane foam, the upper cushioning layer 43 having a hardness of Shore A 10+/−2 and the lower cushioning layer 44 having a hardness of Shore A 7+/−2. The backing plate assembly has a nominal diameter of about 6 inches. The upper cushioning layer 43 has a thickness of about 0.25 inch with a somewhat greater thickness where it is molded to the hub 42. The lower cushioning layer 44 has a thickness of about 1 inch. The hook half 47 of a hook and loop fastening system is attached to the bottom face of the lower cushioning layer 44 in a manner similar to the previously described embodiments. The performance layer 41 comprises a layer of open cell polyurethane foam having a thickness of about 0.375 inch. The performance layer is preformed into a dish shape by heat forming a polypropylene sheet and the loop half 48 of the hook and loop fastening system to the back face of the performance layer to fix the dish shape of the layer. A thin circular hook strip 50 is attached to the outer surface of lower cushioning layer 44. The composite outer edge of the cushioning layers 43 and 44 is formed to a shape that is semi-circular in cross section to match closely the semi-circular shape of the outer edge 51 of the performance layer 41. When the performance layer 41 is attached to the lower cushioning layer 44 in engagement with the hook half 47 and thin hook strip 50, the performance layer is held securely in a self-centering manner. This is important to maintain proper dynamic balance of the system. If a preformed pad is used, the thin hook strip 50 may be eliminated.

However, the dish shaped performance layer 41 performs another important function in this embodiment. Wrapping the performance layer around the rounded cushioned edge 52 permits the operator to buff on an angle from flat face contact that may proceed to a full 90° (i.e. perpendicular to the front face of the pad) in a fully cushioned manner. This permits buffing polishing and finishing in areas of contour change or that are difficult to reach in a manner that protects against cutting or burning the surface being finished. There are no sharp edges or abrupt changes in pad contour that, under the load imposed by the operator during the finishing operation, are not protected by a substantial cushioning layer. This is a marked improvement over all prior art finishing devices.

In order to test the efficacy of the apparatus shown in FIGS. 7 and 8, performance layers 41 of three different grades of open cell polyurethane foam were tested with the graded cushioning system of the present invention, both for the load required to attain a given deflection and for the recovery of the system after repeated loads to provide that given deflection. The three grades of performance layer foam that were used represent the range of open cell polyurethane pads typically used in buffing, polishing and finishing operations. The same tests were run on full thickness pads (i.e. 1.25 inch) of the same three foam materials using a conventional prior art backing plate.

With the thin performance layer pads of the present invention, the vertical load required to compress the entire assembly of backing plate and thin performance layer by 0.5 inch did not exceed about 75 lbs. The full thickness pads of the prior art were mounted on conventional backing plates having a hard plastic hub and a cushioning layer of vinyl nitrile having a thickness of about 0.5 inch. The loads required to attain 0.5 inch compression ranged as high as 229 lbs. for the stiffest of the three foam materials tested. For the system of the present invention, the percent change between the initial compressive load required to compress the system by 0.5 inch and the minimum compressive load after 1 minute relaxation at the 0.5 inch deflection was in the range of 20%-40%. By comparison, the corresponding range for full thickness 1.25 inch pads mounted on a conventional backing plate was 44%-61%.

The tests show that the system of the present invention provides both lower initial loads and a lower change in permanent deformation. This translates directly to lower operator fatigue and more uniform performance over the life of the pad.

What is claimed is:

1. A surface buffing and finishing apparatus of the type providing flexible cushioned support for a high performance surface contacting face, said apparatus comprising a flexible plastic backing plate having a high compression load deflection and having molded thereto a polymeric foam cushioning layer made from two foam layers of different densities, said cushioning layer having a lower compression load deflection than the plastic backing plate and providing a graded compression load deflection that decreases from a rear face to a front face, said backing plate and cushioning layer together providing the flexible cushioned support, and a relatively thin disposable performance layer having a thickness not greater than about 0.5 inch and providing the entire high performance surface contact for buffing, polishing or finishing to provide a desired surface finish, comparable to that provided by a conventional full thickness pad having a typical thickness of about 1.25 inches, when said performance layer is attached to said cushioning layer, and, when so attached, said apparatus has a maximum initial vertical compressive load when compressed 0.5 inch of not more than about 75 pounds, and a change between said maximum initial load and a minimum relaxed load after repeated cycles of 0.5 inch compression held for one minute in the range of about 20% to 40%, the foam cushioning layer defined by an outer edge that is generally circular in cross section, and the performance layer having a rounded outer edge with an inner surface that abuts and conforms to the outer edge of the cushioning layer, said performance layer removably attached to the foam cushioning layer with a demountable fastener, whereby the entire apparatus except the performance layer is preserved for multiple re-use.

2. The apparatus as set forth in claim 1 wherein the performance layer comprises open cell polyurethane foam.

3. The apparatus as set forth in claim 1 wherein the performance layer is selected from the group consisting of open cell polyurethane foam, non-woven fibers, tufted wool, knitted wool, polymeric microfibers, and combinations thereof.

4. The apparatus as set forth in claim 1 wherein the foam cushioning layer has a circular shape and has one-half of a hook and loop fastener attached to its front face; and, the performance layer has a rear face carrying the other half of the hook and loop fastener and having an operating face selected to provide a surface contact optimized for a given buffing, polishing or finishing operation.

5. The apparatus as set forth in claim 4 wherein the fastener halves are heat laminated to the respective faces of the foam cushioning layer and the performance layer.

6. The apparatus as set forth in claim 4 wherein the fastener halves are glued to the respective faces of the foam cushioning layer and the performance layer.

7. The apparatus as set forth in claim 4 wherein at least one of the interface between the fastener halves and the respective faces of the foam cushioning layer and the performance layer is provided with a barrier material to prevent migration of liquid and compound from the performance layer to the foam cushioning layer.

8. The apparatus as set forth in claim 7 wherein the barrier layer is between the rear face of the performance layer and the other half of the fastener.

9. The apparatus as set forth in claim 1 wherein the front face of the foam cushioning layer is generally planar and terminates in an outer edge that is upwardly rounded, a portion of the one-half of the fastener is positioned on the rounded outer edge, and the other half of the fastener on the performance layer is dimensioned to extend over said outer edge to engage the portion of said one-half of the fastener and impart a cup shape to the performance layer.

10. The apparatus as set forth in claim 1 wherein the cushioning layer is molded to the backing plate.

11. The apparatus as set forth in claim 10 wherein the backing plate comprises a molded nylon and the cushioning layer comprises a molded urethane.

12. The apparatus as set forth in claim 1 wherein the performance layer is preformed to a dish shape chosen to conform to a rounded outer edge of the cushioning layer.

13. A surface buffing and finishing apparatus of the type providing flexible cushioned support for a high performance surface contacting face, said apparatus comprising a flexible plastic backing plate having a high compression load deflection and having molded thereto a polymeric foam cushioning layer made from two closed cell urethane foam layers of different densities, said cushioning layer having a lower compression load deflection than the plastic backing plate and providing a graded compression load deflection that decreases from a rear face to a front face, said cushioning layer including an inner layer having a Shore A hardness in the range of about 15 to 30 and an outer layer having a Shore A hardness in the range of about 7 to 10, said backing plate and cushioning layer together providing the flexible cushioned support, and a relatively thin disposable performance layer of open cell polyurethane foam having a thickness not greater than about 0.5 inch and providing the entire high performance surface contact for buffing, polishing or finishing to provide a desired surface finish, comparable to that provided by a conventional full thickness open cell polyurethane pad having a typical thickness of about 1.25 inches, when said performance layer is attached to said cushioning layer, the foam cushioning layer defined by an outer edge that is generally circular in cross section, and the performance layer having a rounded outer edge with an inner surface that abuts and conforms to the outer edge of the cushioning layer, said performance layer removably attached to the foam cushioning layer with a demountable fastener, whereby the entire apparatus except the performance layer is preserved for multiple re-use.

14. The apparatus as set forth in claim 13 wherein the foam cushioning layer has a circular shape and the inner layer has one-half of a hook and loop fastener attached to its front face; and, the performance layer has a circular shape and a rear face carrying the other half of the hook and loop fastener.

15. The apparatus as set forth in claim 14 wherein at least one of the interface between the fastener halves and the respective faces of the foam cushioning layer and the performance layer is provided with a barrier material to prevent migration of liquid and compound from the performance layer to the foam cushioning layer.

16. The apparatus as set forth in claim 15 wherein the barrier layer is between the rear face of the performance layer and the other half of the fastener.

17. The apparatus as set forth in claim 13 wherein the cushioning layer is molded to the backing plate.

18. The apparatus as set forth in claim 17 wherein the backing plate comprises a molded nylon and the cushioning layer comprises a molded urethane.

19. A surface buffing and finishing apparatus of the type providing flexible cushioned support for a high performance surface contacting face, said apparatus comprising a flexible plastic backing plate having a high compression load deflection and having molded thereto a polymeric foam cushioning layer made from two foam layers of different densities, said cushioning layer having a lower compression load deflection than the plastic backing plate and providing a graded compression load deflection that decreases from a rear face to a front face, said backing plate and cushioning layer together providing the flexible cushioned support, and a relatively thin disposable performance layer having a thickness not greater than about 0.5 inch and providing the entire high performance surface contact for buffing, polishing or finishing to provide a desired surface finish, comparable to that provided by a conventional full thickness pad having a typical thickness of about 1.25 inches, when said performance layer is attached to said cushioning layer, and, when so attached, said apparatus has a maximum initial vertical compressive load when compressed 0.5 inch of not more than about 75 pounds, and a change between said maximum initial load and a minimum relaxed load after repeated cycles of 0.5 inch compression held for one minute in the range of about 20% to 40%, the foam cushioning layer having a circular outer edge, and the performance layer having an outer edge that is aligned with and conforms to the outer edge of the cushioning layer, said performance layer removably attached to the foam cushioning layer with a demountable fastener, whereby the entire apparatus except the performance layer is preserved for multiple re-use.

20. The apparatus as set forth in claim 19 wherein the outer edge of the foam cushioning layer is generally circular in cross section and the outer edge of the performance layer is rounded to conform to the outer edge of the cushioning layer.

* * * * *